US005787743A

United States Patent [19]

Weigard

[11] Patent Number: 5,787,743

[45] Date of Patent: Aug. 4, 1998

[54] TORQUE LIMITING LOCK MECHANISM

[75] Inventor: Samuel R. Weigard, Columbia, Pa.

[73] Assignee: PDQ Industries, Inc., Leola, Pa.

[21] Appl. No.: 747,815

[22] Filed: Nov. 18, 1996

[51] Int. Cl.[6] ..... E05B 15/16

[52] U.S. Cl. ..... 70/422; 70/222; 292/336.3; 292/348

[58] Field of Search ..... 70/222–224, 422, 70/380, 381; 292/336.3, 336.5, 347, 348

[56] References Cited

U.S. PATENT DOCUMENTS

| | | | |
|---|---|---|---|
| 4,679,420 | 7/1987 | Yang | 70/222 X |
| 4,773,240 | 9/1988 | Foshee | 70/222 |
| 4,941,697 | 7/1990 | Fan | 70/422 X |
| 5,010,755 | 4/1991 | Best | 70/222 X |
| 5,040,652 | 8/1991 | Fish et al. | 70/422 X |
| 5,390,517 | 2/1995 | Yamada | 70/224 X |
| 5,516,161 | 5/1996 | Mader et al. | 70/422 X |
| 5,520,427 | 5/1996 | Mader et al. | 70/222 X |

*Primary Examiner*—Suzanne Dino
*Attorney, Agent, or Firm*—Martin Fruitman

[57] ABSTRACT

The apparatus is a torque limiting spindle for lock mechanisms. The interconnection between two parts of the spindle of the lock is a detent mechanism which disengages the two sections if excessive torque is applied. The apparatus has a first section of the spindle with grooves on a cylindrical surface and dowel pins held into the grooves by one or more springs. The second section of the spindle has fingers which engage the dowel pins to impart rotational motion to the first spindle section. If the torque applied between the two sections exceeds the limit determined by the springs, the dowel pins move out of the grooves to prevent damage to the mechanism.

4 Claims, 5 Drawing Sheets

TORQUE LIMITING LOCK MECHANISM

BACKGROUND OF THE INVENTION

This invention deals generally with locks and more specifically with a torque limiting apparatus within a lock structure.

The door locks we use every day are undergoing significant changes due to new laws regarding accessibility of public buildings for handicapped individuals. Perhaps the most obvious of such changes is the much more prevalent use of levers to replace the old style round doorknob. Surprisingly, the use of levers raises some problems that were not very significant with the old style doorknob.

One such problem is the ability to apply a great deal of torque to the lock spindle because of the lever arm of the lever. Such forces were very difficult to attain with a round knob. However, the force which can be applied through a lever, both innocently or in an attempt to break in, can be great enough to damage the internal components of a lock and even prevent it from operating from the unlocked side of the door. Clearly, in an application such as a hotel room, it is imperative that tampering with a room door does not trap the occupants within the room.

Some attempts to solve the problem of excessive force applied to the lever have been attempted. A shear pin is one device which has been used in prior art devices to protect the lock mechanism from destructive torque. In such a lock, the spindle, the shaft which is operated by the door lever, is made in two parts, and the interconnection between the two parts includes a breakable pin. When the lever is subjected to excessive torque, the shear pin breaks and protects the lock mechanism from damage.

Another structure which has been used is a shaft with a weakened section. In such an arrangement excessive torque simply causes the lever shaft, the spindle, to break, and the lock mechanism is thereby protected.

While such arrangements prevent lock damage, they are terribly inconvenient for the user of the lock. Both techniques permanently disable the lock, and although the cost of the replacement parts is not great, each system requires disassembly of the lock and consumes significant time and labor to correct. Considering the hotel room situation, it means that a guest returning to a room can not gain access if the lever has been subjected to excessive torque, and it means that maintenance personnel are needed, not only to reestablish the lever's proper operation, but also to simply give the guest access to the room.

SUMMARY OF THE INVENTION

The present invention eliminates both the inconvenience and the cost of repair due to the damage of the lock which results from the use of the prior art systems. The preferred embodiment of the invention provides a resettable torque limiting apparatus, which breaks the interconnection between the lever and the lock mechanism when subjected to excessive torque. However, the apparatus of the invention is instantly resettable to its original condition so that access is not denied to legitimate users and absolutely no repair or part replacement is required.

This is accomplished by interconnecting the lever to the lock mechanism through a detent apparatus. The detent connection, which operates between two separate sections of the spindle, permits relative rotation between the two sections when torque between the lever and the lock mechanism exceeds the design limit of the detent connection. Once the detent is released, the lever rotates independent of the lock mechanism. Therefore, no significant torque can be applied to the lock mechanism from the lever. Nevertheless, when the lever is rotated back into the position at which the detent engages, the entire system operates normally.

For instance, if a hotel guest finds the lever of the guest room hanging down and rotating limply with no resistance, all that is required to gain access through the door is to rotate the lever into its proper horizontal orientation where the detent will once more engage, and then use the key and lever in normal fashion to gain access to the room.

Although a detent apparatus located almost anywhere in the interconnecting system between the lever and the lock mechanism is appropriate for the present invention, ease of manufacture, controlability, cost, and aesthetic considerations suggest the desirability of the preferred embodiment.

In the preferred embodiment the lever is attached to a lever spindle upon which is mounted a sleeve with two fingers protruding from the sleeve end which is remote from the lever. The two fingers fit around the end of the operating spindle which is a cylinder with two cylindrical grooves on its surface. The grooves are parallel to the spindle axis. Dowel pins fit into the grooves in the operating spindle, and two shoes with surfaces matching the end of the operating spindle, and grooves matching the dowel pins, fit around the operating spindle and the dowel pins. The shoes and the fingers are shaped so that the shoes can move away from the center of the axis if sufficient force is applied.

Together, the shoes and the fingers on the lever spindle sleeve completely surround the end of the operating spindle and capture the dowel pins. The shoes, fingers and dowel pins are held in place by one or more springs shaped essentially as a "C", which are installed around the fingers and the shoes.

Thus, with the dowel pins located in the grooves in both the shoes and the operating spindle, rotating the lever also rotates the operating spindle which operates the lock mechanism. However, if the torque applied to the lever overcomes the force of the "C" springs which hold the dowel pins in the grooves in the operating spindle, the pins push the shoes outward, away from the axis of the spindle, and the pins move out of the grooves and onto the cylindrical surface of the end of the operating spindle. In that condition there is no significant connection between the lever spindle and the operating spindle so that no torque can be applied to the mechanism of the lock.

The effect to the user of the lever and the lock is that in normal use the lock operates in the same manner as other locks. However, if excessive torque in applied to the lever, for instance when the door is locked and the lever is normally prevented from rotating by the lock mechanism, the lever is automatically disconnected from the lock mechanism before either can be damaged. Nevertheless, to reestablish normal operation, it is only necessary to rotate the lever until the dowel pins once more fit into the grooves in the operating spindle. It is at that point that the invention returns to normal operation.

The present invention therefore prevents accidental or intentional damage to door locks and levers, while eliminating the time and expense of replacing prior art parts which are designed to break in order to furnish the same protection.

DETAILED DESCRIPTION OF THE INVENTION

Figure 1:
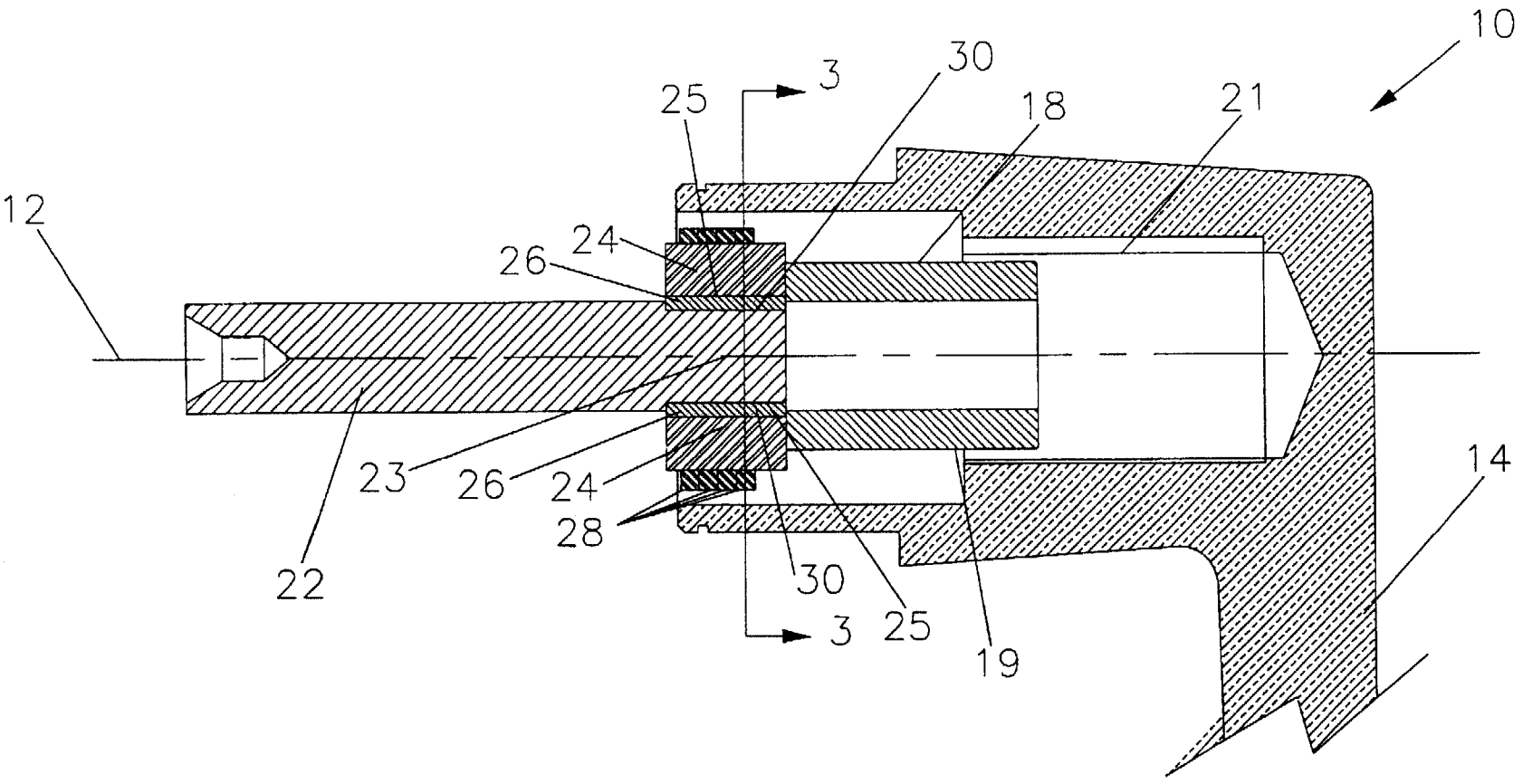
FIG. 1 is a cross section view of the preferred embodiment of the invention along the axis of the spindle.

FIG. 1 is a cross section view of the preferred embodiment of breakaway spindle 10 of the invention. FIG. 1 is a view along axis 12 of breakaway spindle assembly 10 in which lever 14 is rotationally rigid relative to sleeve 18 by virtue of the squared end 19 of sleeve 18 being located in a square hole 21 in lever 14.

Figure 2:
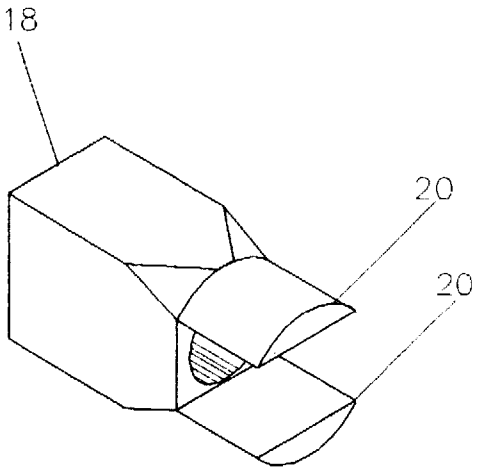
FIG. 2 is a perspective view of sleeve 18 of the preferred embodiment of the invention.

As shown in FIG. 2, sleeve 18 is constructed as a square body with two protruding fingers 20. The function of fingers 20 is to engage and rotate shoes 24 which are engaged with operating spindle 22 through dowel pins 26, as will be described later in regard to FIG. 3 and FIG. 4.

Figure 3:
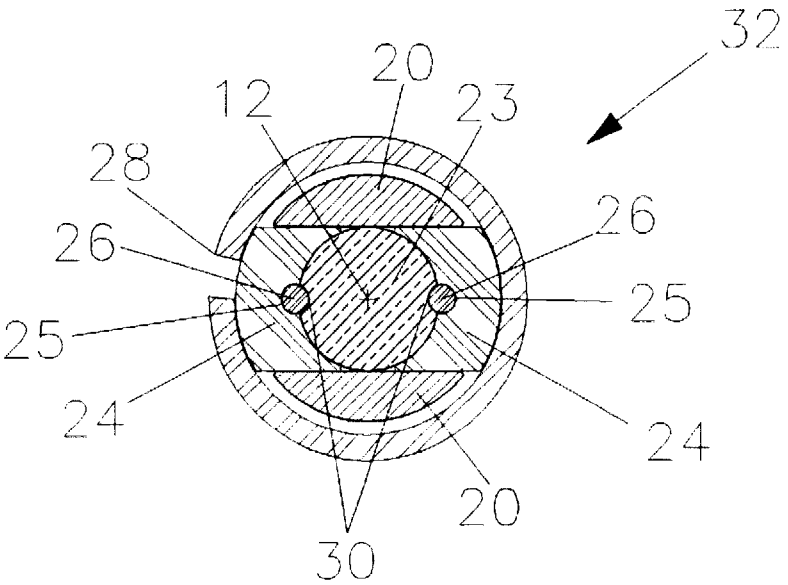
FIG. 3 is a cross section view of the preferred embodiment of the invention at plane 3—3, which is perpendicular to the spindle axis, and shows the detent assembly engaged.
Figure 4:
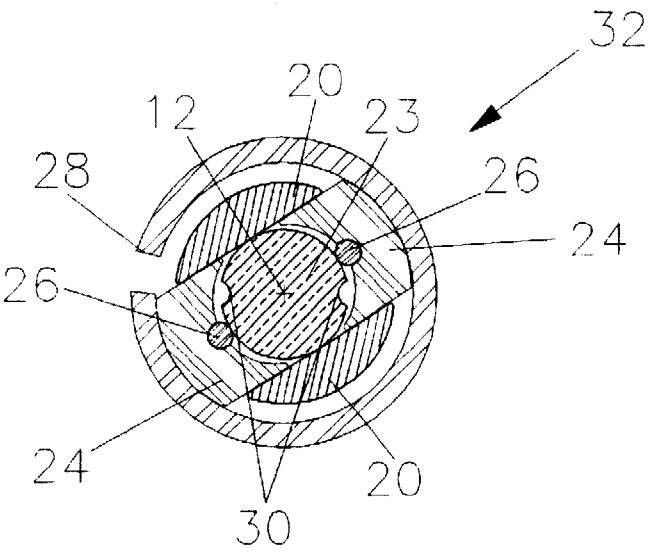
FIG. 4 is a cross section view of the preferred embodiment of the invention at plane 3—3, which is perpendicular to the spindle axis, and shows the detent assembly disengaged.

FIG. 1 also shows the location along axis 12 of spindle shoes 24, dowel pins 26, and "C" springs 28 upon breakaway spindle assembly 10. These parts are located at the junction between sleeve 18 and operating spindle 22. As can be seen in FIGS. 1, 3, and 4, dowel pins 26 are located within grooves 30 located on the cylindrical end 23 of operating spindle 22. Grooves 30 are parallel to but offset from axis 12, and spindle shoes 24 also have grooves 25 which also mate with dowel pins 26.

FIG. 3 is a cross section view of the preferred embodiment of the invention at plane 3—3 (FIG. 1). The plane of FIG. 3 is perpendicular to spindle axis 12 and shows detent assembly 32 engaged. As can be seen in FIG. 3, end 23 of operating spindle 22 is cylindrical in configuration and includes grooves 30 (also seen in FIG. 4). Dowel pins 26 are normally seated in grooves 30, and spindle shoes 24, which include grooves 25, are seated around operating spindle end 23. Fingers 20 of sleeve 18 complete the enclosure around, but have relatively little contact with, operating spindle end 23. However, fingers 20 act as guides to permit spindle shoes 24 to move radially away from axis 12 and act to rotate shoes 24 when sleeve 18 is rotated about axis 12. "C" springs 28 hold detent assembly 32 together and provide the force which determines the torque at which detent assembly 32 disengages.

FIG. 4, like FIG. 3, is a cross section view of the preferred embodiment of the invention at plane 3—3 perpendicular to spindle axis 12. FIG. 4 shows detent assembly 32 disengaged. In FIG. 4 spindle shoes 24 have rotated relative to operating spindle end 23 because they have been forced around by fingers 20. This only occurs if the torque applied between operating spindle end 23 and fingers 20, which are attached to lever 14 (FIG. 1), exceeds the resisting torque which is applied by dowel pins 26 within grooves 25 and 30. When the resisting torque is surpassed, dowel pins 26 roll out of the grooves and ride up on the outer surface of operating spindle end 23, thus essentially breaking the interconnection between the lever and the lock mechanism.

The magnitude of the resisting torque created by dowel pins 26 sitting in grooves 25 and 30 is determined by the force of springs 28 on spindle shoes 24, and this can be incrementally adjusted by both the stiffness of springs 28 and the number of such springs which are used to surround spindle shoes 24 and fingers 20.

As can be appreciated from FIGS. 3 and 4, when the detent action caused by dowel pins 26 located within grooves 25 and 30 is disengaged as shown in FIG. 4, no damage is inflicted upon the assembly. All that is required to reestablish proper operation of the lock mechanism is to rotate the parts back into the configuration of FIG. 3, and dowel pins 26 will automatically reseat within the grooves, reconnecting the lever to the operating spindle with both the original operating action and torque limitation.

Figure 5:
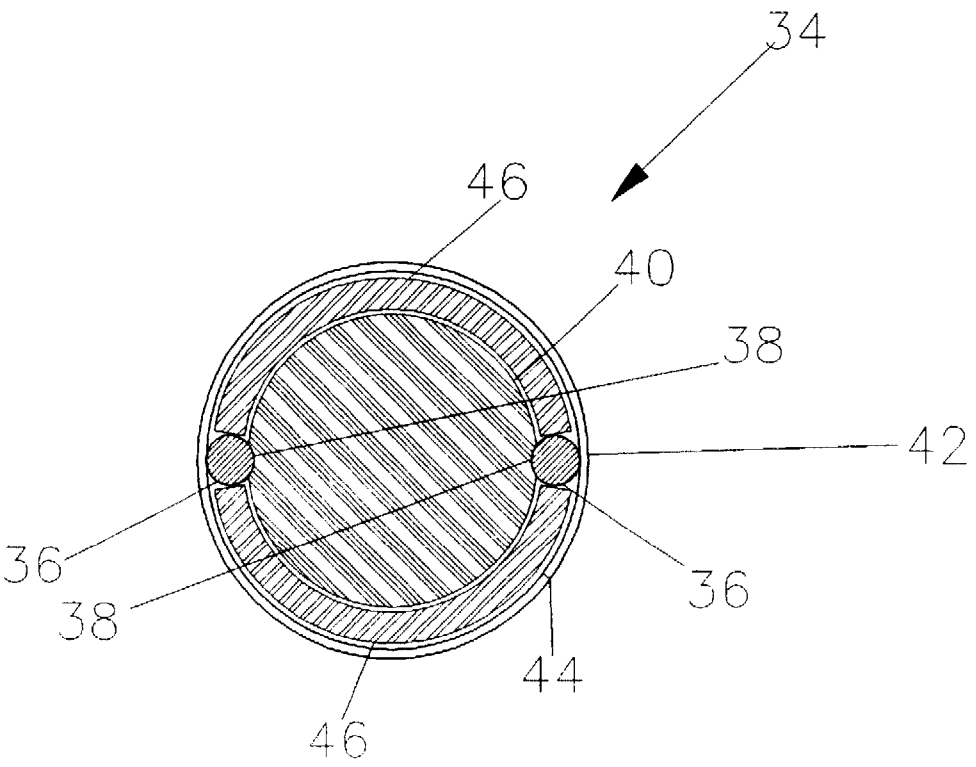
FIG. 5 is a cross section view of an alternate embodiment of the invention in a plane perpendicular to the axis of the spindle which uses a different structure to accomplish the detent action.

FIG. 5 is a cross section view of an alternate embodiment of the invention in a plane perpendicular to the axis of the spindle which operates similarly to the preferred embodiment but uses a different structure, with fewer parts, to accomplish the detent action.

In detent assembly 34 of FIG. 5, dowel pins 36 are seated in grooves 38 in operating spindle 40, and the dowel pins are held in place by direct contact with spring 42 which has split 44. The only other significant parts of detent assembly 34 are fingers 46, which are interconnected with a lever (not shown) in a manner similar to that discussed for the embodiment shown in FIG. 1.

Thus, in FIG. 5 spring 42 holds dowel pins 36 within grooves 38, and as fingers 46 rotate with their associated lever, dowel pins 36 cause operating spindle 40 to rotate. However, if operating spindle 40 is locked, the rotational force applied to dowel pins 36 by fingers 46 causes dowel pins 36 to move out of grooves 38, and no further torque is applied to operating spindle 40. Nevertheless, as in the embodiment of FIG. 1, all that is necessary to reestablish operation of the lock assembly is to rotate the lever until detent assembly 36 once more engages dowel pins 36 into grooves 38.

The present invention therefore affords the protection of limiting the torque which can be applied to a lock mechanism, but involves neither repairs nor disassembly to reestablish normal operation after the unit has been subjected to excess torque.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the shape of the grooves in the operating spindle can be varied, and the number and strength of the springs can be modified to vary the breakaway torque. Moreover, sleeve 18 could be integrated directly into lever 14 or into lever spindle 16, and ball detents or different dowel pin cross sections could be substituted for the dowel pins shown.

What is claimed as new and for which Letters Patent of the United States are desired to be secured is:

1. An apparatus for limiting the torque applied to a lock mechanism comprising:

a lock spindle which is a longitudinal structure which rotates around an axis, and is divided along the axis into a first section of the lock spindle and a second section of the lock spindle, the sections of the lock spindle being located on separate portions of a common axis and meeting at a common junction transverse to the axis; and a detent mechanism interconnecting the first section and the second section of the lock spindle, with the detent mechanism constructed to disengage the first section from the second section when the torque applied between the first section and the second section exceeds a predetermined limit wherein the first section of the lock spindle is interconnected with a lock mechanism and the second section of the lock spindle is interconnected to a door lever.

2. An apparatus for limiting the torque applied to a lock mechanism comprising:

a lock spindle which is a longitudinal structure which rotates around an axis, and is divided along the axis into a first section of the lock spindle and a second section of the lock spindle; and a detent mechanism interconnecting the first section and the second section of the lock spindle, with the detent mechanism constructed to disengage the first section from the second section when the torque applied between the first section and the second section exceeds a predetermined limit, wherein the detent mechanism comprises:

at least one groove in a cylindrical surface of the first section of the spindle with the cylindrical surface and the groove oriented parallel to the axis of the spindle;

a dowel pin located partially within at least one groove;

a spring applying a force to hold the dowel pin in the groove;

at least one finger interconnected with the second section of the spindle and extending in a direction parallel to the axis of the spindle, with the finger located adjacent to the cylindrical surface of the first section of the spindle and oriented parallel to a dowel pin in a groove, so that rotation of the second section of the spindle causes a finger to apply force to a dowel pin and to rotate the first section of the spindle; and with the configuration of the groove and the force of the spring selected so that, at a preselected torque applied between the first section and the second section of the spindle, the force from the finger will cause the dowel pin to move out of the groove and onto the cylindrical surface of the first section.

3. The apparatus of claim 2 wherein the spring is a "C" spring which encircles the fingers and the dowel pins.

4. The apparatus of claim 2 further including at least one spindle shoe located between a finger and a dowel pin and held against the cylindrical surface of the first section of the spindle by the spring, the spindle shoe including a groove parallel to the dowel pin within which the dowel pin is held and also including a smooth surface in contact with the finger, so that, as the dowel pin moves out of the groove on the cylindrical surface of the first section of the spindle, the spindle shoe slides relative to the finger as the spindle shoe moves away from the spindle axis.

* * * * *